US005950992A

United States Patent [19]

Weid

[11] Patent Number: 5,950,992

[45] **Date of Patent: *Sep. 14, 1999**

[54] GUARDRAIL REFLECTOR ASSEMBLY

[76] Inventor: Karl Weid, 1276 Robinwood Dr., Elgin, Ill. 60123

[ * ] Notice: This patent is subject to a terminal disclaimer.

[21] Appl. No.: 08/865,458

[22] Filed: May 29, 1997

[51] Int. Cl.[6] ..... A01K 3/00

[52] U.S. Cl. ..... 256/13.1; 256/1; 256/66; 404/16

[58] Field of Search ..... 256/13.1, 66, 1; 404/6, 7, 8, 9, 10, 16

[56] References Cited

U.S. PATENT DOCUMENTS

| | | | |
|---|---|---|---|
| D. 392,203 | 3/1998 | Weid | D10/111 |
| D. 393,425 | 4/1998 | Weid | D10/111 |
| 4,000,882 | 1/1997 | Penton | 256/13.1 |
| 4,221,498 | 9/1980 | Schueler et al. | 404/16 X |
| 4,224,002 | 9/1980 | Heenan et al. | 256/13.1 X |
| 4,354,772 | 10/1982 | Drexler | 256/13.1 X |
| 4,626,127 | 12/1986 | May | 404/16 X |
| 4,717,281 | 1/1988 | Shepherd et al. | 404/16 |
| 4,723,758 | 2/1988 | Gehrig | 256/1 X |
| 5,393,166 | 2/1995 | Stock et al. | 404/16 X |
| 5,731,895 | 3/1998 | Owczarzak et al. | 404/9 X |

FOREIGN PATENT DOCUMENTS

| | | | |
|---|---|---|---|
| 3412999 | 7/1985 | Germany | 404/10 |
| 4224549 | 1/1994 | Germany | 256/13.1 |

*Primary Examiner*—Daniel P. Stodola
*Assistant Examiner*—Bruce A. Lev
*Attorney, Agent, or Firm*—Mathew R. P. Perrone, Jr.

[57] ABSTRACT

A guardrail reflector assembly is attached to the corrugated rail of the guardrail or to the post of guardrail with glue due to the flexibility of the reflector assembly.

14 Claims, 3 Drawing Sheets

FIG. 2
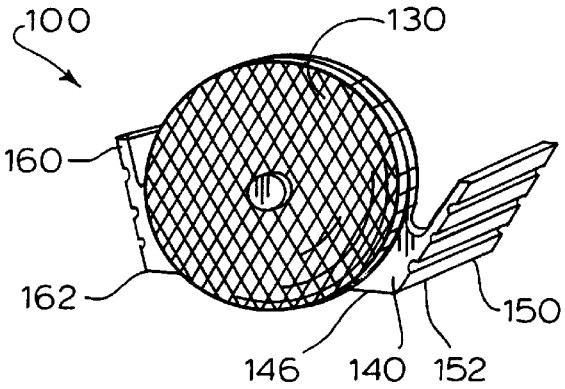
FIG. 3
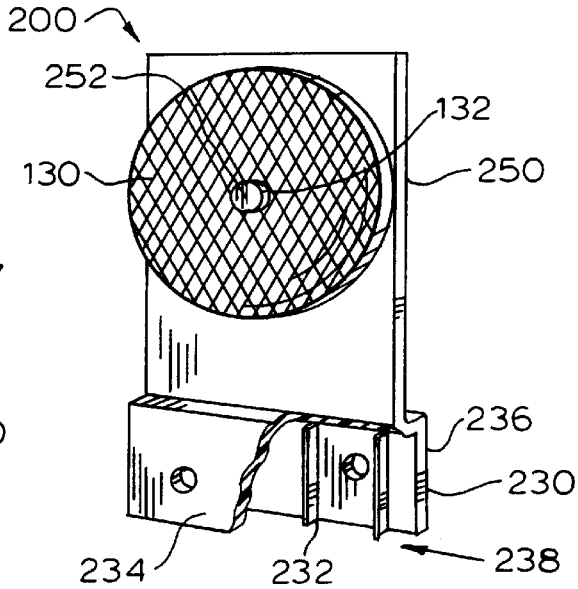
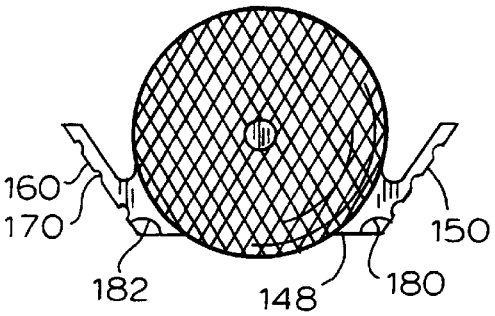
FIG. 4
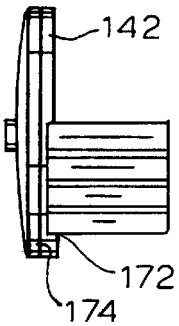
FIG. 5
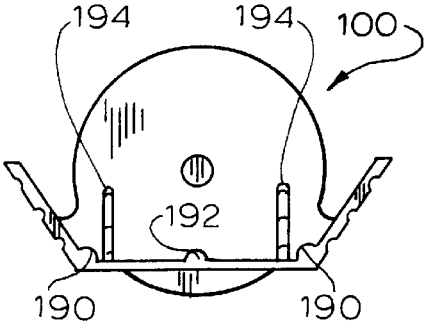
FIG. 6

FIG. 7
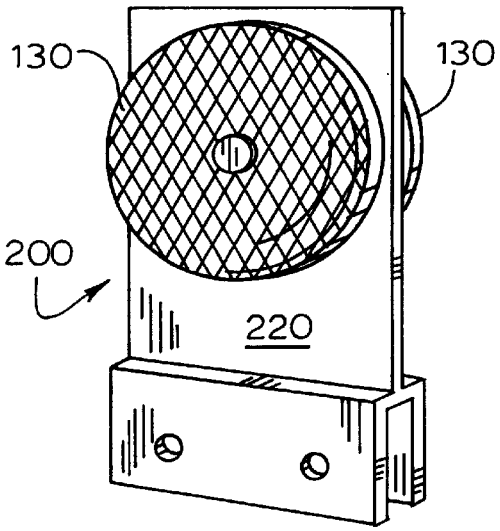
FIG. 8
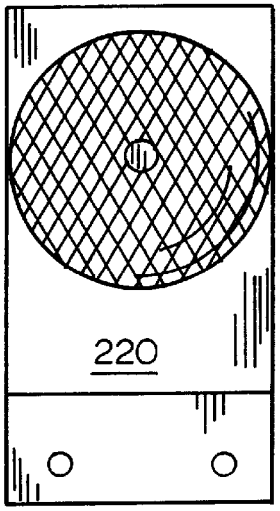
FIG. 9
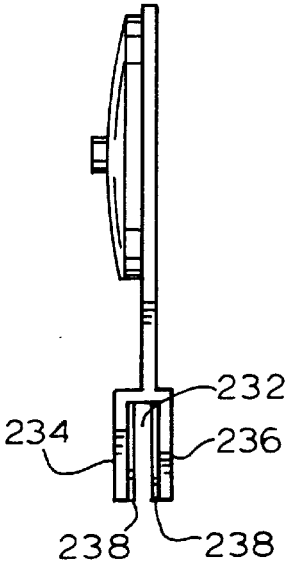
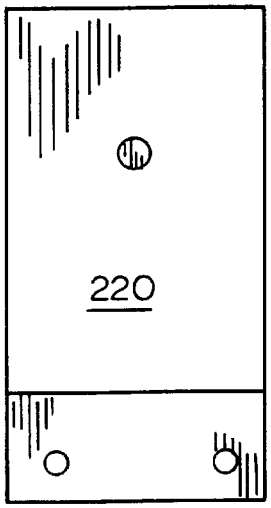
FIG. 10
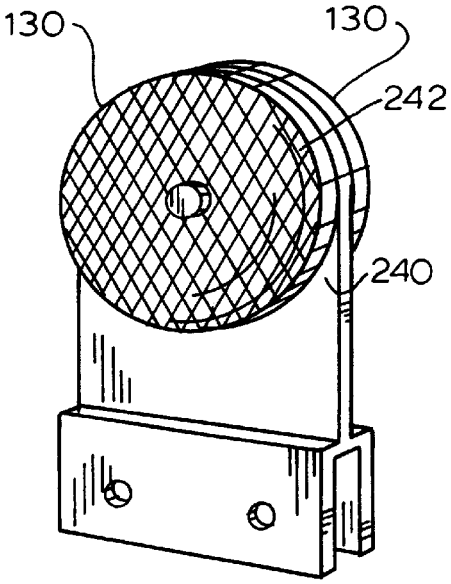
FIG. 11
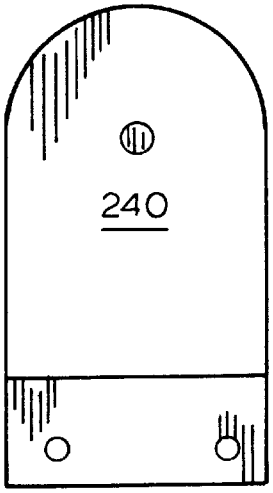
FIG. 12

GUARDRAIL REFLECTOR ASSEMBLY

This invention relates to a safety reflector assembly and more particularly to a safety reflector assembly mounted to a guardrail, especially a safety reflector suitable for use on a highway guardrail.

BACKGROUND OF THE INVENTION

Guard rails are a very important item of automobile safety. A typical guardrail has I-beam shaped posts in the ground. Mounted on the face of the I-beam shaped post are corrugated rails. These guardrails are very strong and can serve a great function in preventing auto accidents or keeping cars from going off the road. When they do this, great advantages are obtained.

The idea of the rail is to prevent a car from either getting into further trouble or suffering more extensive damage, while at the same time providing protection and appropriate usage of a vehicle. These safety devices are very critical for curves in roads, or for roads that run along the edge of cliffs.

These guardrails are even better if reflectors can efficiently be secured thereto. However, it is also desired to very efficiently apply reflectors to these items. It is very difficult to efficiently apply reflectors to such a guard rail because there is a matter of having the reflector be visible and be efficiently attached to the guardrail.

If the reflector has to be bolted on, great expense occurs, both in the attaching time and the manufacturing time to provide for such attachment. Also, the required drilling of the bolt holes can adversely effect the strength of the guardrail. Accordingly, it is desired to attach these reflectors by a system other than bolting.

A standard way of attaching reflectors to guardrails is gluing the reflectors in place. However, since these guardrails are metal, the different co-efficient of expansion between the plastic reflectors and metal guardrail causes a problem. These different expansion rates, due to heat, causes the glue holding the reflector on the metal to weaken. The reflectors then fall off.

If a method can be adapted to secure these reflectors to the guardrail, in a very efficient manner, while avoiding the bolting and drilling, the strength of the guardrail is maintained while at the same time the reflectors are put in place. It is clear that the reflectors are a great advantage because they permit to guardrails to be seen more easily and more efficiently.

A preferred place to adhere a reflector is in the center of a corrugated guardrail. However, the co-efficient of the expansion can force the even a bolted on reflector to break and loose its effectiveness. Thus, it is desired to find ad efficient way of applying this guardrail while at the same time keeping the expensive of applying the reflectors reduced. In this fashion, the advantages of reflectors on guardrails can be obtained without undesirable results.

Another preferred place of securing a reflector to a guardrail is on the I-beam shaped post support. Similar problems occur with the attachment of reflectors there too. The attachment must be strong and efficient. If these problems can be solved, great advantages can be obtained.

SUMMARY OF THE INVENTION

Among the many objectives of this invention is to provide a guardrail reflector assembly for simplified mounting on the guardrail.

Another objective of this invention is to provide a guardrail reflector assembly for the post of a guardrail.

Yet another objective of this invention is to provide a guardrail reflector assembly, which is easily attached to the corrugated rail of a guardrail.

Still another objective of this invention is to provide a guardrail reflector assembly, which may be glued to the guardrail.

Additionally, an objective of this invention is to provide a flexible guardrail reflector assembly.

Also, an objective of this invention is to provide a guardrail reflector assembly, which stays in position.

A further objective of this invention is to provide a guardrail reflector assembly having two reflective surfaces.

A still further objective of this invention is to provide a method for easily attaching a guardrail reflector assembly.

Yet a further objective of this invention is to provide a strong guardrail reflector assembly.

These and other objectives of the invention (which other objectives become clear by consideration of the specification, claims and drawings as a whole) are met by providing a guardrail reflector assembly to be attached to the corrugated rail of the guardrail or to the post of guardrail.

BRIEF DESCRIPTION OF DRAWINGS

FIG. 2 depicts a front perspective view of the rail reflector assembly 100.

FIG. 3 depicts a front perspective view of the post reflector assembly 200.

FIG. 4 depicts a front, plan view of rail reflector assembly 100.

FIG. 5 depicts a side view of rail reflector assembly 100.

FIG. 6 depicts a rear, plan view of rail reflector assembly 100.

FIG. 7 depicts a rear, perspective view of post reflector assembly 200 having a second reflector disk 130.

FIG. 8 depicts a front, plan view of post reflector assembly 200 with a rectangular base 220.

FIG. 9 depicts a side view of post reflector assembly 200.

FIG. 10 depicts a rear, plan view of post reflector assembly 200.

FIG. 11 depicts a rear, perspective view of post reflector assembly 200 having a second reflector disk 130, with a rounded base 240.

FIG. 12 depicts a rear, plan view of post reflector assembly 200 with a rounded base 240.

Throughout the figures of the drawings where the same part appears in more than one figure the same number is applied thereto.

DESCRIPTION OF THE PREFERRED EMBODIMENTS

Figure 1:
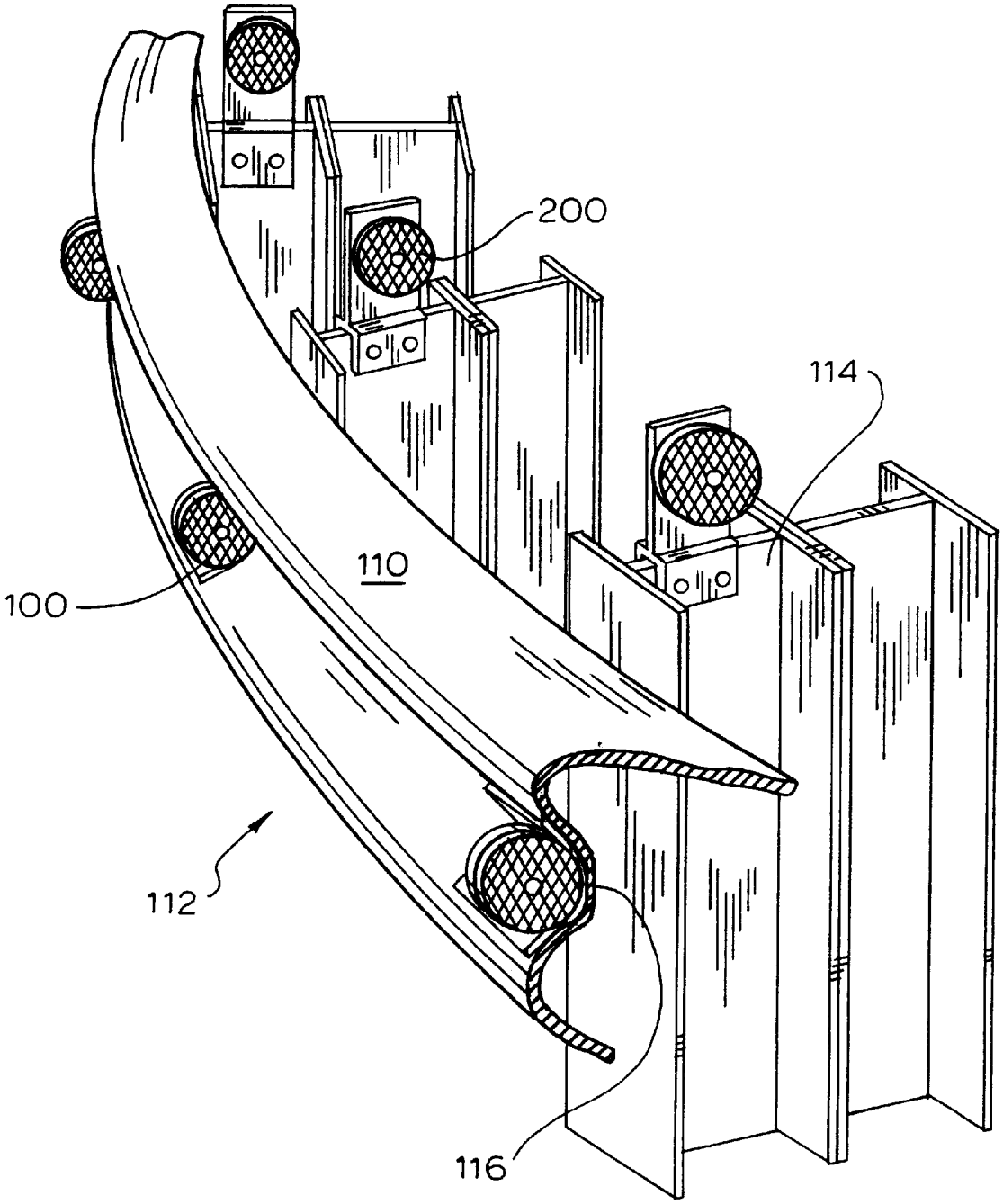
FIG. 1 depicts a perspective view of a rail reflector assembly 100 mounted on a corrugated rail 110 of a guardrail 112 and a post reflector assembly 200 mounted on an I-beam shaped post 114 of guardrail 112.

For making a guardrail more visible, a reflector assembly may be attached to the center of the corrugated portion of the guardrail and to the support posts of the guardrail. Both reflector assemblies are attached by gluing.

Each reflector assembly has a reflector base with at least one reflecting face mounted on the reflector base. The structure of the reflector assemblies permits them to be easily glued in place on the guardrail and remain there hold for a substantial period of time.

A suitable reflector assembly for affixing in the center of the corrugated portion of the guardrail can be accomplished by making a reflector mounted on a reflector face. The reflector face is partially surrounded by the base, and is perpendicular to the plane of the base.

The base has a main portion, and wing portions protruding off of the base at each end. The base is grooved. The grooves provide strength for the wings, and also permit the reflector to be molded more easily. Also, the grooves provide for flexibility while maintaining the strength of the base. In this fashion, the reflector can flex as the metal expands and contracts and the reflector can stay in place, within the corrugated portion of the guardrail.

With regard to a post reflector assembly for the I-beam shaped post, a slotted reflector is desired. The slotted reflector includes a flat base having a mounting end and a visible end oppositely disposed from the mounting end. The visible end receives at least one reflective surface or reflector. If two reflectors are desired, they are on opposite sides of the flat base at the visible end.

From the visible end, the flat base extends into the mounting end. The mounting end has a ribbed slot between two sides at the base thereof. This permits the post reflector assembly to slide over the I-beam shaped post of the guardrail and provide the necessary support. In this fashion, the desired results can be obtained of safety, attachment, and efficiency.

The ribbed slot includes ribs in the base between the two sides thereof. These ribs provide for the strength of the attachment of the glue to the post. Preferably these ribs are three in number on each side, semi-circular in nature, and parallel to the longitudinal axis of the post reflector assembly.

Referring now to FIG. 1, guardrail 112 has a rail reflector assembly 100 mounted on a corrugated rail 110 of the guardrail 112 and a post reflector assembly 200 mounted on an I-beam shaped post 114 of guardrail 112. More than one of rail reflector assembly 100 or post reflector assembly 200 are preferably desired to be mounted on guardrail 112.

Adding FIG. 2, FIG. 3, FIG. 4, FIG. 5, and FIG. 6, to the consideration, the structure of rail reflector assembly 100 becomes clear. Rail reflector assembly 100 is affixed in the center 116 of the corrugated rail 110 portion of the guardrail 112.

Rail reflector assembly 100 is formed by having a reflector disk 130 mounted on a rail reflector housing 140 at reflector face 142. The reflector face 142 is partially encircled or surrounded by the angled base 146. Preferably angled base 146 is perpendicular to the plane of the reflector face 142 at a leading edge 172 thereof.

The angled base 146 has a main portion 148 with a first winged portion 150 protruding off of the angled base 146 at a first base end 152 and a second winged portion 160 protruding off of the angled base 146 at a second base end 162. The angled base 146 is grooved. The plurality of grooves 170 provide strength for the first winged portion 150 and the second winged portion 160. Grooves 170 also permit the rail reflector housing 140 to be molded more easily.

As shown, reflector face 142 is preferably circular in shape. Main portion 148 forms a chord 174 with reflector face 142. First winged portion 150 extends beyond reflector face 142 and forms a first obtuse angle 180 relative to main portion 148 protruding off of the angled base 146 at a first base end 152.

In a manner similar to first obtuse angle 180, second winged portion 160 protrudes from the angled base 146 at a second obtuse angle 182. Of course, second winged portion 160 protrudes off of the angled base 146 at a second base end 162. Thus, rail reflector assembly 100 has an axis of symmetry.

Situated at both first obtuse angle 180 and second obtuse angle 182 is wing support 190. Each wing support 190 strengthens its respective first winged portion 150 or second winged portion 160. Each winged support 190 preferably has a partially circular cross-section.

Between the winged supports 190 is centrally located face support 192 on main portion 148. Face support 192 also has a partially circular cross-section. Between face support 192 and each winged support 190 is a face buttress 194 supporting and connecting main portion 148 and the reflector face 142. Face buttress 194 is preferably of triangular shape.

Also, an additional advantage of the grooves 170 is that they provide for flexibility while maintaining the strength of the rail reflector housing 140. In this fashion, the rail reflector assembly 100 can flex as the corrugated rail 110 expands and contracts, with changes in temperature. The rail reflector assembly 100 can stay in place, within the corrugated rail 110 of the guardrail 100.

Grooves 170 can have any reasonable shape and be present in any reasonable number. Preferably grooves 170 are three in number on each of first winged portion 150 and second winged portion 160. Grooves 170 preferably have a semicircular cross-section.

Reflector face 142 is preferably circular in shape. Main portion 148 forms a chord 174 with reflector face 142. First winged portion 150 extends beyond reflector face 142 and forms an obtuse angle 180 relative to main portion 148 protruding off of the angled base 146 at a first base end 152 and a second winged portion 160 protruding off of the angled base 146.

FIG. 3, FIG. 8, FIG. 9, and FIG. 10 combine to depict post reflector assembly 200. With regard to the I-beam shaped post 114, the slotted or post reflector assembly 200 includes a flat base 220. The flat base 220 has a mounting end 230 to receive I-beam shaped post 114, and a visible end 250 oppositely disposed from the mounting end 230.

The visible end 250 receives at least one reflective surface or reflector 130. If two reflectors 130 (FIG. 7) are desired, they are on opposite sides of the flat base 220 at the visible end 250. Preferably reflector 130 is circular in nature with a center aperture 132. Centrally located in visible end 250 is mounting pin 252 to receive reflector 130 at central aperture 132. This central aperture 132 combined with glue (not shown) secures reflector 130 to visible end 250.

If a second reflector disk 130 is mounted on post reflector assembly 200. The dual reflectors 130 provide for ease viewing of guardrail 110 from either traffic direction. This procedure is especially effective on a two lane road.

From the angled visible end 250, the rectangular flat base 220 extends into the mounting end 230. The mounting end 230 has a ribbed slot 232 between a first side 234 and a second side 236 at the mounting end 230 thereof. This permits the post reflector assembly 200 to slide over the I-beam shaped post 114 of the guardrail 110 and provide the necessary support. In this fashion, the desired results can be obtained of safety, attachment, and efficiency.

The ribbed slot 232 includes ribs 238 in the base between the first side 234 and the second side 236. These ribs 238 provide for the strength of the attachment of the glue to the post 114. Preferably these ribs 238 are four in number on each side, flattened in nature, and parallel to the longitudinal axis of the post reflector assembly.

FIG. 11 and FIG. 12 depict post reflector assembly 200 with a rounded base 240 replacing flat rectangular base 220. Rounded base 240 provides a shape to match reflector 130, which is mounted in the described fashion at rounded visible end 242.

If a second reflector disk 130 is mounted on post reflector assembly 200, post reflector assembly 200 can be more easily seen by traffic from different directions. The dual reflectors 130 provide for ease of viewing for the guardrail 110 from either traffic direction. This procedure is especially effective on a two lane road.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A reflector enhanced guardrail assembly including a corrugated rail supported on at least one mounting post to form a guardrail, the guardrail having a guardrail reflector system mounted thereon in order to form the reflector enhanced guardrail assembly, the guardrail reflector system comprising:

(a) the guardrail reflector system including a post reflector and a rail reflector;

(b) the post reflector being mounted on the at least one mounting post;

(c) the rail reflector being mounted on the corrugated rail;

(d) the rail reflector including a flexible means to adapt the reflector to a change in temperature;

(e) the post reflector including a holding means to receive the at least one mounting post;

(f) the rail reflector including a rail face and a rail base;

(g) the rail base including the flexible means;

(h) the rail face including a reflecting device;

(i) the rail base adapting to an expansion or a contraction of the corrugated rail;

(j) the rail face being substantially perpendicular to the rail base;

(k) the rail base including a main portion, a first wing section and a second wing section;

(l) the first wing section and the second wing section forming a part of the flexible means;

(m) the first wing section and the second wing section each having at least one groove;

(n) the at least one groove providing both strength and flexibility for the first wing section and the second wing section; and (o) the at least one groove providing ease of molding for the rail reflector.

2. The reflector enhanced guardrail assembly of claim 1 further comprising:

(a) the rail face being substantially in the shape of a circle;

(b) the main portion forming a chord with the circle; and (c) the first wing section and the second wing section being tangential to the rail face.

3. The reflector enhanced guardrail assembly of claim 2 further comprising:

(a) the main portion having a first end oppositely disposed from a second end;

(b) the first wing section extending from the first end of the main portion; and (c) the second wing section extending from the the second end of the main portion.

4. The reflector enhanced guardrail assembly of claim 1 further comprising:

(a) the post reflector including a slotted reflector;

(b) the slotted reflector including a flat base;

(c) the flat base having a mounting end and a visible end oppositely disposed from the mounting end;

(d) the visible end including at least one reflective surface;

(e) the mounting end having a ribbed slot;

(f) the ribbed slot having a first side extending from the visible end and a second side extending from the visible end to form the ribbed slot; and (g) the first side and the second side each including at least one rib to form the ribbed slot.

5. The reflector enhanced guardrail assembly of claim 4 further comprising:

(a) the mounting post being an I-beam shaped post;

(b) the ribbed slot being adapted to receive the I-beam shaped post;

(c) the ribbed slot providing strength for a glue attachment to the I-beam shaped post;

(d) the at least one rib being three ribs on the first side and three ribs on the second side.

6. The reflector enhanced guardrail assembly of claim 5 further comprising:

(a) the visible end having a shape selected from the group consisting of a circular shape and a rectangular shape;

(b) the visible end having a first reflective surface and a second reflective surface;

(c) the first reflective surface and the second reflective surface being on opposite side of the flat base; and (d) the at least one rib including four ribs on the first side and four ribs on the second side.

7. The reflector enhanced guardrail assembly of claim 5 further comprising:

(a) the rail reflector including a rail face and a rail base;

(b) the rail base including the flexible means;

(c) the rail face including a reflecting device; and (d) the rail base adapting to an expansion or a contraction of the corrugated rail.

8. The reflector enhanced guardrail assembly of claim 7 further comprising:

(a) the rail face being substantially perpendicular to the rail base;

(b) the rail base including a main portion, a first wing section and a second wing section; and (c) the first wing section and the second wing section forming a part of the flexible means.

9. The reflector enhanced guardrail assembly of claim 8 further comprising:

(a) the first wing section and the second wing section each having at least one groove;

(b) the at least one groove providing both strength and flexibility for the first wing section and the second wing section; and (c) the at least one groove providing ease of molding for the rail reflector.

10. The reflector enhanced guardrail assembly of claim 9 further comprising:

(a) the rail face being substantially circular;

(b) the main portion forming a chord with the rail face; and (c) the first wing section and the second wing section being tangential to the rail face.

11. The reflector enhanced guardrail assembly of claim 10 further comprising:

(a) the main portion having a first end oppositely disposed from a second end;

(b) the first wing section extending from the first end of the main portion; and (c) the second wing section extending from the the second end of the main portion.

12. A rail reflector adapted for mounting on a corrugated rail of a guardrail, the rail reflector comprising:

(a) the rail reflector including a rail face and a rail base;

(b) the rail base including a flexible means for supporting the rail reflector on the corrugated rail;

(c) the rail face including at least one reflecting device;

(d) the rail base adapting to an expansion or a contraction of the corrugated rail;

(e) the rail face being substantially perpendicular to the rail base;

(f) the rail base including a main portion, a first wing section and a second wing section;

(g) the first wing section and the second wing section forming a part of the flexible means;

(h) the first wing section and the second wing section each having at least one groove;

(i) the at least one groove providing both strength and flexibility for the first wing section and the second wing section; and (j) the at least one groove providing ease of molding for the rail reflector.

13. The rail reflector of claim 12 further comprising:

(a) the rail face being substantially in the share of a circle;

(b) the main portion forming a chord with the circle;

(c) the first wing section and the second wing section being tangential to the rail face;

(d) the main portion having a first end oppositely disposed from a second end;

(e) the first wing section extending from the first end of the main portion; and (f) the second wing section extending from the second first end of the main portion;

(g) the post reflector being adapted for mounted on the I-beam shaped post;

(h) the post reflector including a holding means to receive the I-beam shaped post.

14. A post reflector adapted for mounting on a post of guardrail, the post reflector comprising:

(a) the post reflector assembly including a slotted reflector;

(b) the slotted reflector including a flat base;

(c) the flat base having a mounting end and a visible end oppositely disposed from the mounting end;

(d) the visible end including at least one reflective surface;

(e) the mounting end having a ribbed slot;

(f) the ribbed slot having a first side extending from the visible end and a second side extending from the visible end to form the ribbed slot;

(g) the first side and the second side each including at least one rib to form the ribbed slot;

(h) the mounting post being an I-beam shaped post;

(i) the ribbed slot being adapted to receive the I-beam shaped post;

(j) the ribbed slot providing strength for a glue attachment to the I-beam shaped post;

(k) the at least one rib being three ribs on the first side and three ribs on the second side;

(l) the visible end having a shape selected from the group consisting of a circular shape and a rectangular shape;

(m) the visible end having a first reflective surface and a second reflective surface;

(n) the first reflective surface and the second reflective surface being on opposites of the flat base; and (o) the at least one rib including four ribs on the first side and four ribs on the second side.

* * * * *